United States Patent [19]

Bräuning

[11] Patent Number: 4,641,885

[45] Date of Patent: Feb. 10, 1987

[54] WORK CHAIR HAVING A VERTICALLY ADJUSTABLE CHAIR SUPPORT

[75] Inventor: Egon Bräuning, Weil am Rhein, Fed. Rep. of Germany

[73] Assignee: Protoned B.V., Amsterdam, Netherlands

[21] Appl. No.: 624,979

[22] Filed: Jun. 27, 1984

[30] Foreign Application Priority Data

Jul. 20, 1983 [CH] Switzerland ..... 3973/83

[51] Int. Cl.[4] ..... A47C 3/00

[52] U.S. Cl. ..... 297/300; 297/304; 297/292

[58] Field of Search ..... 297/300, 301, 303, 304, 297/292

[56] References Cited

U.S. PATENT DOCUMENTS

| | | | |
|---|---|---|---|
| 3,542,422 | 11/1970 | Flint | 297/300 |
| 3,603,640 | 9/1971 | Doerner | 297/300 X |
| 4,084,850 | 4/1978 | Ambasz | 297/300 X |
| 4,200,332 | 4/1980 | Bräuning | 297/300 |
| 4,451,085 | 5/1984 | Franck et al. | 297/300 X |
| 4,479,679 | 10/1984 | Fries et al. | 297/300 |

FOREIGN PATENT DOCUMENTS 2925520 1/1981 Fed. Rep. of Germany ..... 297/301

*Primary Examiner*—Kenneth J. Dorner
*Assistant Examiner*—José V. Chen
*Attorney, Agent, or Firm*—Ladas & Parry

[57] ABSTRACT

The work chair is provided with a one-piece chair shell (8), in the rear region of which an integrally incorporated hinge portion (11) is formed between the lumbar region and buttocks portion (12) and the backrest portion (11). The seat shell (13) contains a base bearer (14) which forms part of an adjusting mechanism and on which the chair shell (8) is suspended for longitudinal movement by means of spring-loaded pivoting members (27, 32). The base bearer (14) and the backrest portion (10) are connected together with the aid of a control member (36) fastened by guide means (37, 38), in such a manner that a variation of the inclination of the backrest portion (10) caused by an adjusting force brings about a simultaneous variation of the inclination of the seat shell (13) in the same direction. Through the elimination of the adjusting force, the backrest portion is returned to its normal position or position of rest.

9 Claims, 9 Drawing Figures

WORK CHAIR HAVING A VERTICALLY ADJUSTABLE CHAIR SUPPORT

Figure 1:
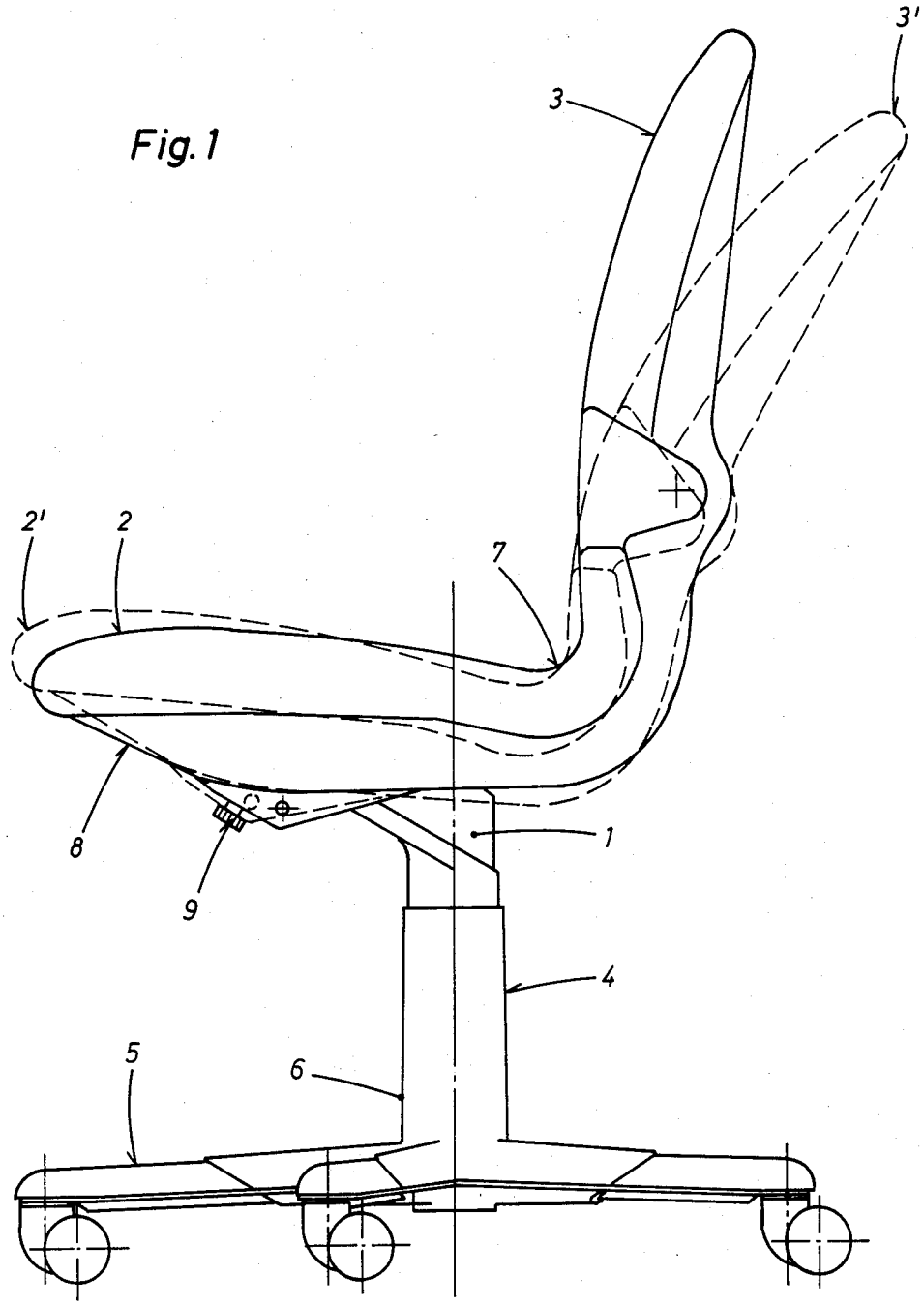

The invention relates to a work chair of the type defined in the preamble of patent claim 1.

Work chairs of this kind are known. In this connection, reference is made to Swiss Pat. No. 524.982 and 629.945. The adjustment mechanisms described therein for the simultaneous alteration in the same direction of the inclination of the backrest and seat relative to the vertical chair pillar contain gas springs. Within the scope of their specific mode of operation, the latter permit on the one hand the convenient adjustment of practically any starting positions of the backrest and seat combination, which is coupled together in respect of movement, so as to achieve a locked position, and on the other hand relatively hard springing for the movability of the backrest and seat through corresponding displacement of the weight of the sitter. Work chairs of this kind are easily and rapidly adjustable to changing requirements in respect of sitting positions, and are capable of practically universal use.

Nevertheless, it is found that in many cases it is sufficient or preferred for work chairs to have a freedom of movement extending from a physically correct "normal posture", in which the buttocks, the adjoining lumbar region and at least the lower part of the spinal column in the lumbar and buttocks regions have physically correct support from the rear, to an alternative posture in which these regions, together with the middle and upper parts of the body lying above them, and thus also the spinal column, can be temporarily relaxed. This relaxing of the spinal column can be made particularly effective if it is shifted slightly backwards, but without losing the supporting action of a support surface shaped for anatomical adaptation. Chair constructions complying with these requirements, made of suitably flexible plastic materials, are already known. Their aim was to make the buttocks region of the seat, the transition from the seat to the lower part of the backrest, and the backrest itself on the one hand sufficiently stiff to avoid undesirable deformation, but on the other hand to adapt the bending line of the backrest and shoulder support as closely as possible to the natural shape of the spinal column when these relaxing movements are made. While it is not as a rule difficult to achieve the necessary rigidity of shape, problems arise in connection with the adaptation of the curvature pattern of the backrest, particularly its upper end region, to the natural shape of the human spinal column. The reason is that the requirements in respect of the mechanical strength of the backrest material and the desired flexural flexibility can substantially be brought into acceptable equilibrium only with "bare" shells of plastic material. In such cases, not only must all forms of padding be dispensed with, but in addition esthetically desirable design elements are also usually out of the question. Above all, for reasons of economy it is not possible to achieve the raising of the front end of the seat, which is advantageous for the relaxing of the body, because chairs having bare shells of plastic material belong to a price category in which movement mechanically required for the purposes are not used.

The problem underlying the present invention is therefore that of providing a work chair which can be equipped with padding and above all can be adapted to average comfort requirements, and which by means of a relatively simple movement mechanisms of robust construction is able to offer anatomically correct support effects within a wide range of possible sitting postures and also to comply with esthetic wishes.

The solution provided by the invention to this problem can be seen in the characterizing features of the patent claim. Embodiments thereof are described in the appendant claims.

The main advantage of the work chair according to the invention can be seen in its simple shell construction, which can comprise not only the seat shell but also the entire backrest arrangement.

The hinge member disposed at the bottom end of the backrest, and forming an integral part of the shell construction, can, without taking into account requirements in respect of shape and strength of the upper part of the backrest, be so shaped that it can comply not only with its main purpose as a bending member, but also with design-oriented demands.

The movement mechanism comprises components few in number and above all not subject to wear, requiring little maintenance. The ability to use a torsion coil spring arrangement makes it possible to provide an adjusting mechanism which is inexpensive to produce and convenient to adjust, and which can be made easy to inspect and consists of only few simple parts. Without modification of the basic construction, the work chair can be designed as an armchair and it can be provided with practically any known pillar and foot construction.

Figures 2, 2A, 2B:
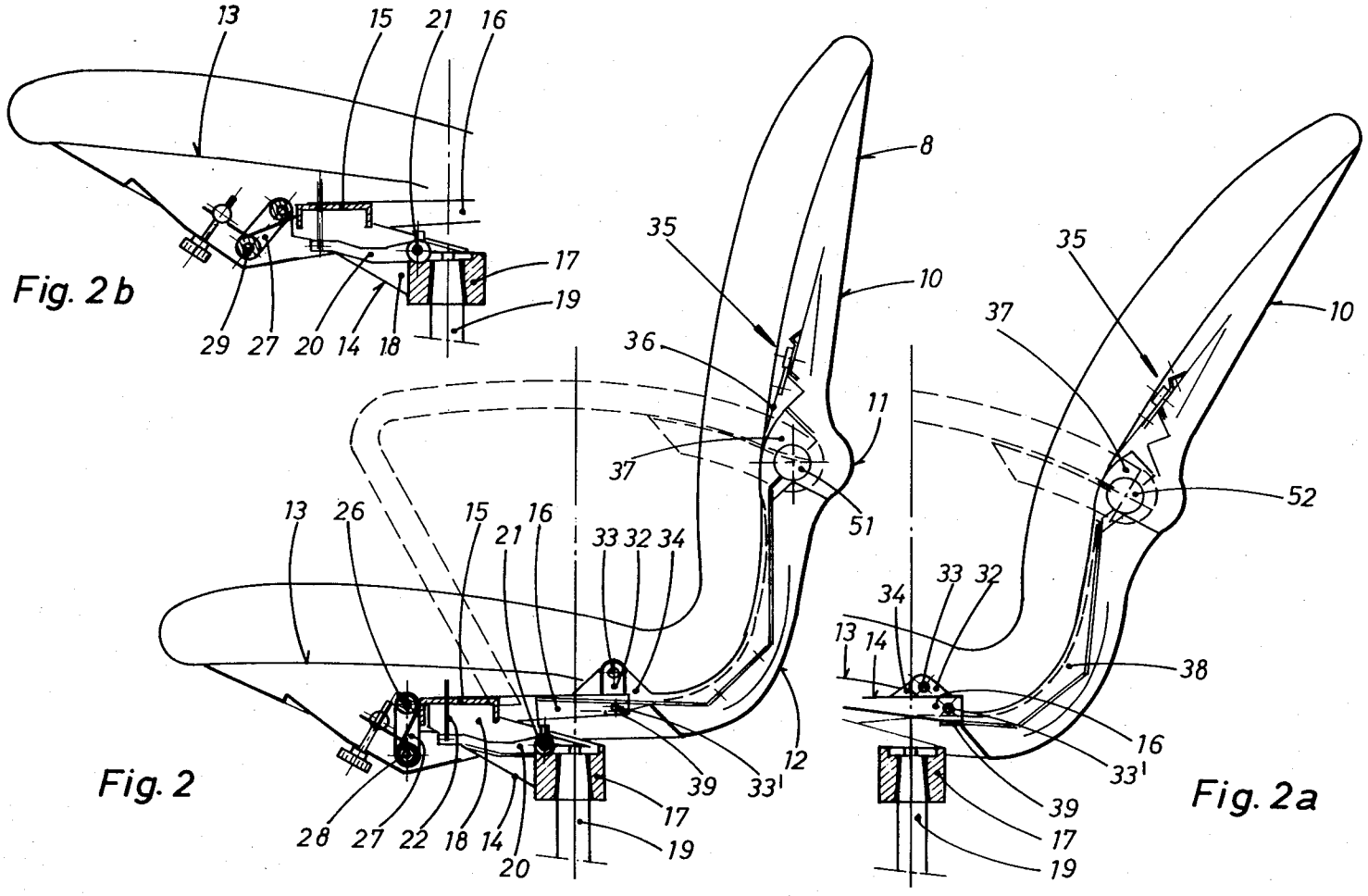
Figure 3:
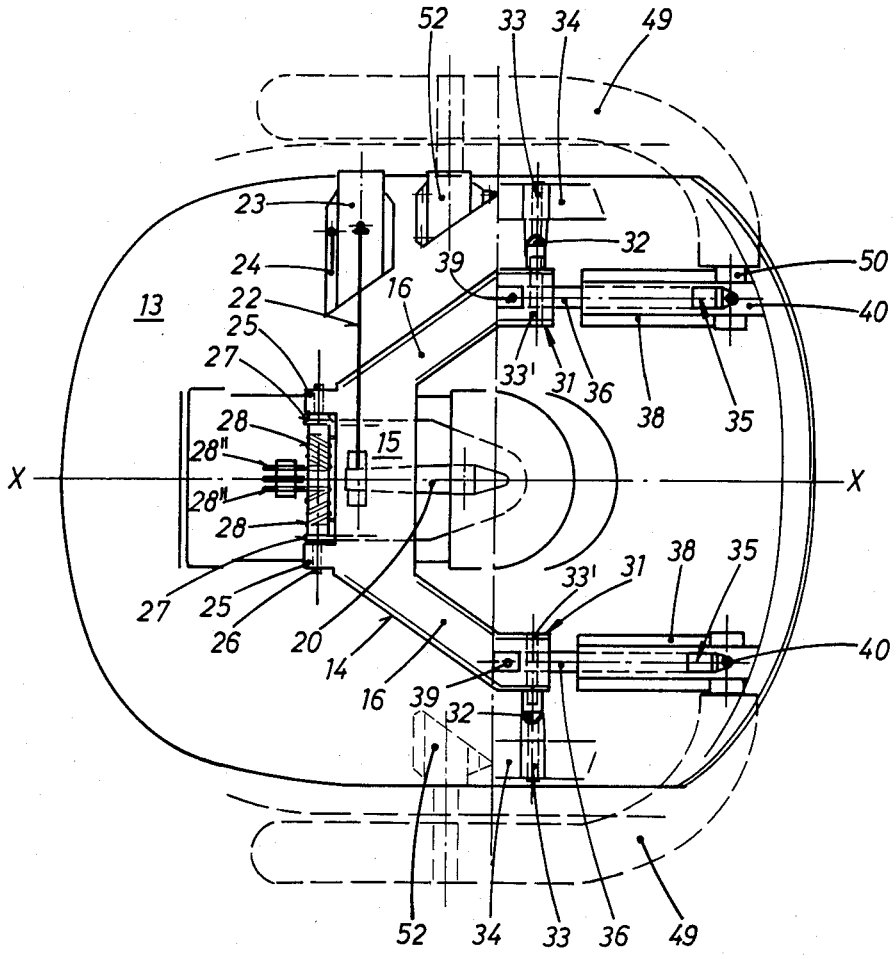
Figure 4B:
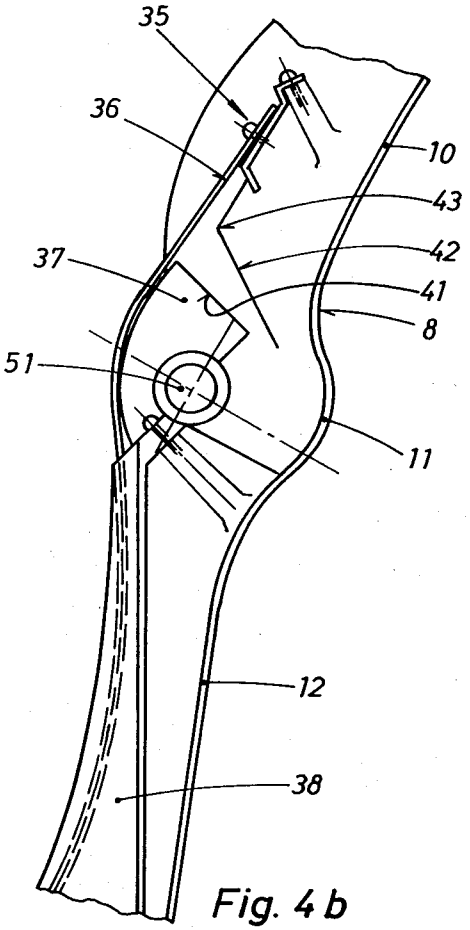
Figure 4A:
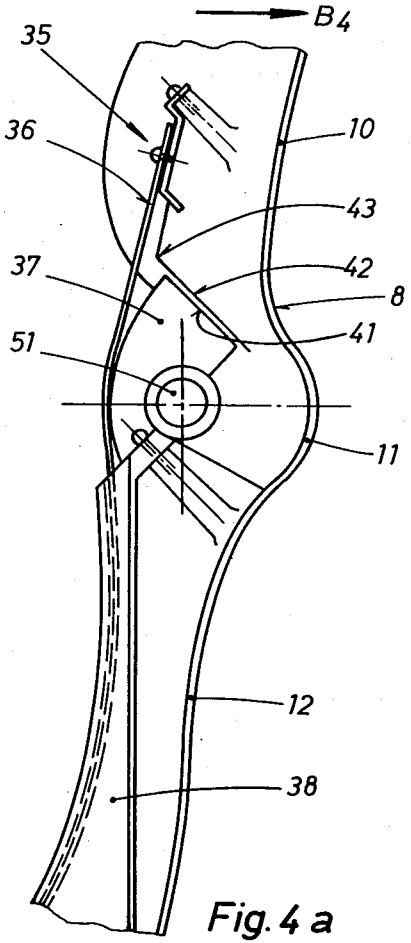
Figure 5A:
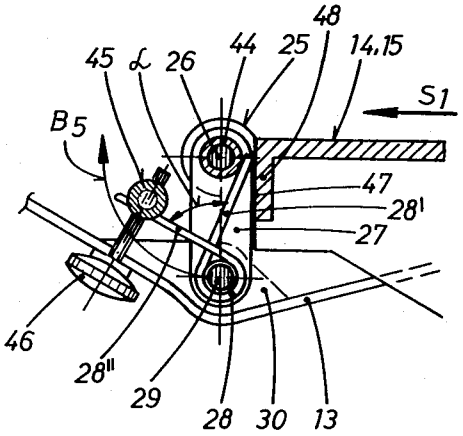
Figure 5B:
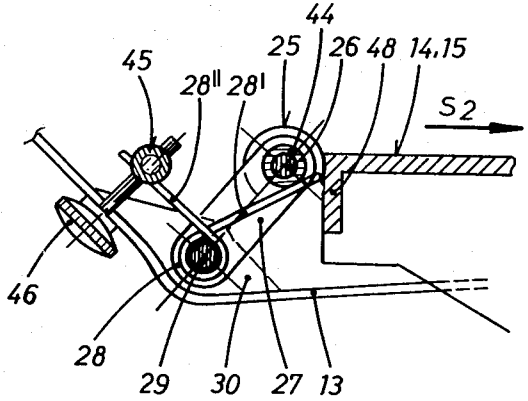

One example of construction of the work chair according to the invention is described below with reference to the drawing, in which:

FIG. 1 is a side view of the chair illustrating the movability of the seat shell and backrest between their normal position or position of rest (in solid lines) and their fully backwardly inclined position (in broken lines), FIG. 2 is a vertical section along the axis of symmetry X—X (in FIG. 3) of the chair, illustrating the seat shell and backrest adjustment mechanism in its normal position or position of rest, FIGS. 2*a* and 2*b* show details of the seat shell and backrest adjustment mechanism, with the backrest fully inclined to the rear, FIG. 2*a* showing the part of the backrest to the right of the vertical transverse plane together with the rear seat shell articulation, while FIG. 2*b* shows the front part of the seat shell to the left of the vertical transverse plane of the chair, FIG. 3 is a plan view of the adjustment mechanism shown in FIG. 2, FIGS. 4*a* and 4*b* show on a larger scale the backrest and bending joint region in (a) the normal position or position of rest of the backrest, and (b) in the fully rearwardly inclined position, and FIGS. 5*a* and 5*b* show on a larger scale the seat shell front part articulation, (a) in the normal position or position of rest of the chair, and (b) with the backrest fully inclined towards the rear and with the front part of the seat shell in a correspondingly raised position relative to the base bearer of the adjustment mechanism.

FIG. 1 shows a work chair which is constructed in accordance with the invention, and in which an upholstered seat part 2, together with a likewise upholstered backrest 3 integral therewith, is mounted on the connector 1 of a base bearer or base-plate. The connector 1 is advantageously mounted for rotation on a chair pillar 4, which may be constructed in the conventional manner in the style of a spring vertically adjustable and rotatable spindle, or may be a gas damper. The chair pillar 4 may for example be fastened on a wheeled supporting spider 5 and be provided with cladding 6 which, as shown, also covers a pair of the arms of the supporting spider. In FIG. 1 the seat part 2 and the backrest 3 are shown in two of their end or main positions, namely (in solid lines) in the normal position or position of rest in which the seat part and the backrest are in a standard position in which the sitter sits on the chair in the normal working posture. In broken lines the seat part and backrest are shown in the position in which the sitter is leaning back to load the upper part of the backrest 3 and, under full load, pivots the backrest 3 into its end position 3'. Under lower loads intermediate positions dependent on the adjusting force are assumed. Simultaneously with the backward pivoting of the backrest, an adjusting mechanism, which will be described with reference to the other Figures of the drawing, initiates an adjustment of the inclination of the seat part as shown at 2', in which a displacement of the buttocks part 7 is also included. It is thus possible to make rocking movements, for which the necessary control force can be determined in dependence on a spring member whose initial stress is adjustable by means of a spindle 9 adapted to be operated from the outside of the chair shell 8.

Identical reference numerals in the other Figures relate in each case to the same component or same part of a component.

The previously mentioned chair shell 8 is an integral piece of plastic material, which at some points is provided with apertures and fastening holes for parts of the adjusting mechanism and the various portions of which are each provided with reinforcing ribs and the like (not shown and not given references) and equipped with connection points for the components of the adjusting mechanism. 10 designates a backrest portion which is practically straight in the vertical direction (FIGS. 2 and 2*a*) and in the horizontal direction is curved outwards only slightly or not at all, and which is formed above a hinge portion 11 projecting in the form of a bead, so that a slight flexural deformability can optionally be adjusted in portion 10. In the downward direction the hinge portion 11 is followed by a portion 12 which, with increasing distance, has increasing curvature in the horizontal direction and therefore is of increasing stiffness, and which supports the lumbar region and buttocks. The continuation of the chair shell 8 in the direction of the front edge of the seat surface forms a structured, planar shell 13 supporting the seat part 2 and hereinafter referred to generally as the seat part shell; to it are fastened supporting and mounting members of the adjusting mechanism, and it will expediently be described in connection with these members and this mechanism.

In the example illustrated the hinge portion 11 is in the form of a horizontal bead determining a definite bending region whose deflection and restoring forces can be adjusted by choice of material (including any integrated reinforcing means) and by design elements (thickness, horizontal and vertical curvature, distance from the neutral bending line) of the chair shell itself, and also by a tensioning device of the adjusting mechanism. This tensioning device forms the control means of the adjusting mechanism and will be described later on in connection with the mode of operation of the latter.

In the region of the seat shell 13 the chair shell 8 is supported by a base bearer 14 which, in accordance with FIGS. 2, 2*b* and 3, contains a central bracket 15, from which two symmetrical arms 16 project in the form of a V in the backward direction, their distal ends being in the form of mounting and bracing members, which will be described later on. The connection head 17 of the chair shell 8 is also connected to the central bracket 15 by means of a fork member 18 in such a manner that the surface of the bracket lies substantially horizontally. The connection head 17 forms the connector between the base bearer 14, and thus the upper part of the chair, and the chair spindle 19 which is disposed in the interior of the chair pillar 4 (FIG. 1) and which in the present case is shown as a vertically adjustable gas damper and hereinafter will be referred to as such. The connection head 17 is substantially identical to the connector 1 shown in FIG. 1 and carries, among other things, a control lever 20 for adjusting the height of the gas damper 19. The control lever 20 is mounted for pivoting about a pin 21 seated on the connection head 17, and is operated by means of a cable 22 which is connected to a control strap 23 projecting laterally over the seat shell 13. This control strap 23 is in turn mounted for sliding or swivelling in a guide member 24 fastened on or inserted into the seat shell 13.

On its side opposite to that where the arms 16 are disposed, the bracket 15 also carries the bearings 25 for a pin 26, on which are supported on the one hand a pair of straps 27 and on the other hand, in each case, one arm 28' of two symmetrical torsion coil springs 28. The pair of straps 27 can be joined to form a U-shaped lever member by a tube joining them together at one end, thus forming a one-piece pivoting member.

Through the rigid mounting of the base bearer 14 on the chair spindle 19, the bearings 25,31 formed directly on the bracket 15 and the arms 16 determine four defined suspension points for the chair shell 8 relative to the chair spindle 19. The previously mentioned bearings 25 at the front end of the bracket 15 are pivotally connected to the seat shell 13 by the pin 26, the pairs of straps 27 pivotable thereon, and another pin 29 (FIGS. 5*a*, 5*b*) in a mounting eye 30. At the distal end of the base bearer arms 16 are situated respective bearings 31 to receive a rocking lever 32 (FIGS. 2, 2*a*, 3), bent in the shape of a Z, with oppositely projecting bearing pins 33, 33'. The one bearing pins 33 are seated respectively in a mounting eye 34 laterally on the seat shell 13, and lie at a somewhat greater height than the second bearing pins 33' engaging in the appertaining bearing 31 on the arm 16. In brief, the seat shell 13 is suspended for pivoting in the longitudinal direction at four points, namely on the one hand by means of the pair of straps 27 and the pin 29, and on the other hand by means of the rocking levers 32 and the bearing pins 33, 33' in mounting eyes 30 and 34 on the base bearer 14. In this regard, see the arrows $S_1$ and $S_2$ in FIGS. 5*a* and 5*b*.

As already mentioned, the deflection and restoring force of the hinge portion 11 at the bottom end of the backrest portion 10 of the chair shell 8, and therefore the movability of the backrest 3, can be controlled, among other ways, by a tensioning device of the adjusting mechanism. This tensioning device is a movement control and tension member arrangement, which is illustrated in FIGS. 2, 2*a* and 3 and partially, on a larger scale, in FIGS. 4*a* and 4*b*, and the components of which are disposed symmetrically to the axis of symmetry X—X (FIG. 3) of the chair. These components each comprise an upper bracing bracket 35 for a tension member 36 acting as control member, which may be a spring steel band, a band of plastic material, a link band member (chain), or a steel cable, together with a guide or deflection segment 37, a tension member channel guide 38, and a bottom bracing bracket 39. The top and bottom bracing brackets 35, 39 are clamp components for the tension member 36, which in the drawing is shown as a spring steel band and hereinbelow will also be referred to as the tension band 36. The top bracing bracket 35 is provided with a connection strap 40 making the connection to the backrest portion 10 of the chair shell 8; the bottom bracing bracket 39 contains a clamp plate (not shown) making the connection to the distal end of each of the arms 16. The tension bands 36 first extend from the upper bracing bracket 35 over the guide or deflection segment 37, whose peripheral curvature ensures a bend-free path for the respective tension band. The tension band then passes into a U-shaped groove which is formed in the channel member 38 both as a rectilinear transverse guide as a convexly curved longitudinal guide, and which leaves the band free from bends in front of the bottom bracing bracket 39. The surface of the bottom of the groove in the channel member 38 is so shaped that there is practically no friction with the tension band 36.

The channel member 38 and the guide or deflection segment 37 are expediently in the form of an integral casting which is bolted fast to the chair shell 8 in the portion 12 supporting the buttocks and lumber regions, but which ensures complete freedom of movement in the hinge portion 11.

From FIG. 4*a*, which shows the "normal" position of the backrest portion 8, it can be seen that in this position a stop surface 41 on the guide or deflection segment cooperates with a stop surface 42 on a limiter block 43 integral with the backrest portion 10 or constituting a stop member fastened to the latter. With the tension band 36 under tensile load, the stop surfaces 41, 42 lie close against one another, so that a forward movement of the backrest portion 10 is prevented. If the portion 10 is loaded in the direction of the arrow $B_4$, the situation shown in FIG. 4b is obtained, in which the backrest portion has moved to the right, "stretching" the hinge portion 11 in the clockwise direction. The stop surfaces 41 and 42 have moved away from one another; the tension band 36 has been pulled upwards.

The mode of operation of the adjusting mechanism can thus now already be seen with the aid of FIGS. 2, 2*a*, 2*b*, 5*a* and 5*b*.

In the position of rest of the chair, shown in FIG. 1 in solid lines, and the position of the adjusting mechanism components shown in FIGS. 2, 4*a* and 5*a*, the initial stress of the torsion coil springs 28 produce the situation in which the base bearer 14 is pulled to the left in the direction of the arrow $S_1$ (FIG. 5*a*). The arms 28′ of the springs 28 thus lie against a tube 44 mounted on the pin 26, while the arms 28″ are prestressed against an abutment roller 45, which with the aid of an initial stress regulating screw 46, supported on the seat shell 13 and identical to the adjustable spindle 9, can be moved in the axial direction of the screw 46. In order to secure the practically vertical position of the pair of straps 27 pivotally mounted by means of the pin 29 in the seat shell 13, as shown in FIG. 5*a*, the rear side surface of the pair of straps lies at 47 against a stop nose 48 of the base bearer 14, or the front side of the bracket 15. This practically vertical position of the pair of straps 27 coincides with the simultaneously likewise practically vertical position of the rocking levers 32, so that with an initial stress on the spring 28, which must always be assumed to exist, a stable normal position or position of rest is obtained for the chair.

As soon as the backrest portion 10 is moved to the right in the direction of the arrow $B_4$ (FIG. 4*a*), or brought into a backwardly inclined position, since the chair shell 8 is an integral body and its portions 12 and 13 are connected together, the extending movement of the tension band 36 gives rise to a relative displacement between the seat shell 13 and the base bearer 14. The latter is pulled back, that is to say to the right, relative to the seat shell 13, or conversely the seat shell 13 is moved forward relative to the base bearer 14. The rocking lever 32 thus rocks in the counterclockwise direction, while at the same time the rear portion of the seat shell 13 is lowered. The abovementioned relative movement between the seat shell and the base bearer 14 brings about a pivoting of the pair of straps 27 in the clockwise direction (FIG. 5*b*) and, through the action of the pin 29 mounted in the seat shell, results in the raising of the front part of the seat shell.

At this point it may be mentioned that the hinge portion 11, so far described as a bulb or bead and thus shown in the drawing, may also have a different profile, for example a corrugated profile, in order to achieve certain pivoting results or an esthetic effect. Similarly, the abovedescribed restriction of the movement of the backrest portion 10 may also be obtained with the aid of stop means (not shown) constructed on the front of the rocking lever 32, while in addition the tensioning spring device 28,46 acting on the pair of straps 27 can be moved to the region of the rocking lever 32. Finally, the stop means may be disposed on one of the rocking levers 27, 32 and the tensioning spring device on the other.

The enlargement of the angle $\alpha$ between the legs (FIG. 5*a*), which occurs on the inclination of the backrest 3 around the hinge portion 11, increases the operating force for the movement of the backrest 3. The same effect is achieved when the initial force must already be increased by corresponding adjustment of the initial stress regulating screw 46. Conversely, by reducing the angle $\alpha$, the adjustment of the backrest can be made softer and thus adapted to individual requirements.

The work chair shown in FIG. 1 may be provided with armrests 49 (shown in broken lines) as indicated in FIGS. 2 and 3, the upper connection region of which armrests is provided with a pin 50 engaging in a corresponding bore 51 in the guide segment 37, while their bottom connection region is fixed in a mounting 52 anchored to the seat shell 13.

I claim:

1. A work chair having a vertically adjustable chair support (19) rigidly joined to a chair support-base bearer (14) on which an integrally formed chair shell (8) is suspended for longitudinal movement by means of a front and rear spring-loaded pair of lever members (27, 32) of an adjustable mechanism, the chair shell (8) being comprised of a seat shell portion (13), a lumbar portion and buttocks supporting portion (12) being rigidly joined with said seat shell portion (13), and a backrest portion (10) being joined with said lumbar portion and buttocks supporting portion (12) by means of a hinge joint (11), the backrest portion (10) of the chair shell (8) further being joined with a tension member arrangement (35–39) which, by the user of the chair pressing back with their shoulders, applies an adjusting force to the backrest portion (10) for the purpose of providing a change in inclination, thereby effecting a synonymous change in the inclination of the seat shell portion (13), the hinge joint further being characterized by an integrally formed flexible hinge portion (11) between the lumbar and buttocks supporting portion (12) and the backrest portion (10), the tension member arrangement (35–39) comprised of a flexible band (36) which moves upwardly when the backrest portion (10) is moved back thereby causing the band (36) to pull the base bearer (14) backwards further producing a flexible connection between the bottom end of the backrest portion (10) and the base bearer (14), which is slidably guided toward the base bearer (14) by means of a movement deflecting device (37) in the region of the hinge portion (11), and via a channel (38) in the lumbar portion and buttocks supporting (12), said movement deflecting device (37) having a curved bearing surface for said flexible band (36) passing into a u-shaped groove which is formed in the channel member (38), the channel member (38) and deflecting device (37) being attached to chair shell (8) in the portion (12) supporting the buttocks and lumbar regions.

2. A work chair according to claim 1, characterized in that the hinge portion (11) is formed as a projection extending rearwards from the chair shell contour in a bead-like or fashion.

3. A work chair according to claim 1, characterized in that the tension member arrangement includes two flexible bands (36) acting together in pairs, one end of the bands being fastened to an upper tension bracket (35) at the bottom end of the backrest portion (10), and the other end thereof being fastened to the base bearer (14).

4. A work chair according to claim 3, characterized in that said base bearer (14) is provided with two symmetrical arms (16) which extend from a central claw (15) to the rear in the form of a V, the rear pair of the lever members (32) being hinged to the ends of said symmetrical arms (16) to provide a hinge connection with said chair shell (8), and the lower tension brackets (39) of said tension member being mounted thereon, the claw (15) further having two bearings (25) which are arranged symmetrically at the front end thereof and at a distance from one another laterally, the front pair of lever members (27) being hinged to the bearings as the second hinge connection with the chair shell (8).

5. A work chair according to claim 4, characterized in that there is provided a symmetrically active screw-torsion spring arrangement (28) for spring-loading at least the front pair of the spring loaded lever members (27), and their being an initial stressing force caused thereby which is adjustable with the aid of an initial stress regulating screw (9, 46) supported on the seat shell (13).

6. A work chair according to claim 1 or 3, characterized in that said tension member arrangement includes tension elements comprised of a steel band.

7. A work chair according to claim 1 or 3, characterized in that said tension member arrangement includes tension elements comprised of a band of plastic material.

8. A work chair according to claim 1 or 3, characterized in that said tension member arrangement includes tension elements comprised of a link belt.

9. A work chair according to claim 1 or 3, characterized in that said tension member arrangement includes tension elements comprised of a cable.

* * * * *